United States Patent [19]

Mark

[11] Patent Number: 4,605,925

[45] Date of Patent: Aug. 12, 1986

[54] INFRA-RED TELEMETRY SYSTEM

[75] Inventor: James S. Mark, Peterborough, Canada

[73] Assignee: Canadian General Electric Co., Ltd., Toronto, Canada

[21] Appl. No.: 621,296

[22] Filed: Jun. 15, 1984

[30] Foreign Application Priority Data

Sep. 9, 1983 [CA] Canada ..... 436336

[51] Int. Cl.[4] ..... G08C 19/36

[52] U.S. Cl. ..... 340/870.29; 340/870.41; 340/648

[58] Field of Search ..... 340/870.29, 870.28, 340/870.41, 648, 672, 679; 73/DIG. 11, 862.33

[56] References Cited

U.S. PATENT DOCUMENTS 4,145,653 3/1979 Voigt ..... 324/158

4,150,358 4/1979 Aviander ..... 340/189

FOREIGN PATENT DOCUMENTS 965840 4/1975 Canada ..... 324/17

OTHER PUBLICATIONS

Lefrancois, W. et al., Optical Detector . . . Synchronous Machines, IEEC & E Paper No. 77251, 1977, Toronto.

"Optical Information Coupling Between Stationary and Rotating Systems"; N. D. Kline, L. F. Mattson.

"Infrared Communication for In-House Applications"; F. R. Gfeller, H. R. Müller and P. Vettiger.

*Primary Examiner*—Jerry W. Myracle

*Attorney, Agent, or Firm*—Paul Checkovich; Jerome C. Squillaro

[57] ABSTRACT

An infra-red telemetry system for transmitting information between a rotating shaft of a dynamoelectric machine and an adjacent stationary location includes a plurality of sources of infra-red radiation spaced equidistanced from one another around the shaft of the dynamoelectric machine and mounted to the shaft of the machine. Information is coded into a pulse train and the pulse train is used to energize the infra-red sources simultaneously. At least one infra-red detector is mounted at a stationary location adjacent the dynamoelectric machine. The infra-red sources are directed to bounce their radiation off a cover plate having a diffuse reflecting surface and mounted on the rotor of the dynamoelectric machine. The bounced radiation is detected by the infra-red detector and decoded to provide the information from the rotor.

14 Claims, 11 Drawing Figures

INFRA-RED TELEMETRY SYSTEM

BACKGROUND OF THE INVENTION

The present invention relates to an infra-red telemetry system, and in particular it relates to a telemetry system using infra-red radiation to transfer information between the rotor of a dynamoelectric machine and a fixed external location.

It is desirable, not only for testing but for continuous monitoring, to be able to transmit information between the rotor of a dynamoelectric machine and a stationary position externally of the machine while the machine is operating. For example, it is desirable to monitor the temperature at a number of specific locations on the rotor during start-up, continuous running and overload conditions. It may also be desirable to monitor voltage, current, relative displacement, strain, torque or flux density at locations on the rotor of a dynamoelectric machine.

Various systems have been developed for monitoring different variables on a rotating machine. One such system uses a radio link. An FM transmitter is mounted on the rotor and an FM receiver is mounted adjacent the machine. Thermocouples or other sensors are coupled to a modulating arrangement in the transmitter and the desired data is output at the receiver. The transmitter and receiver must have suitable antennae to obtain adequate signal transfer and this is sometimes a problem on a rotating machine part. In addition, the radio link is susceptible to interference and may create interference.

Another system for transferring information between a rotor and an external stationary position uses light-emitting diodes or LEDs. This system mounts the light sensitive detectors on the end of the shaft, concentrically with the axis of the machine and the LEDs are mounted directly in line and spaced from the end of the shaft. A pair of an LED transmitter and aligned detector represent one channel for information transfer. The LED and detector can be exchanged to transmit data in the other direction. An arrangement of this type is described in IBM Technical Disclosure Bulletin, Vol. 7, No. 10, March 1965 and entitled "Optical Information Coupling Between Stationary and Rotating Systems". It is, however, frequently not possible to have access to the end of a shaft of a dynamoelectric machine. For example, the shaft of a vertical water driven generator is normally not available for telemetry, and large motors may have loads and other equipment coupled to the ends of their shafts.

An alternate system spaces LEDs axially along the end of a rotor shaft and places photo sensitive detectors opposite them. For example, Canadian Pat. No. 965,840—Smith, issued Apr. 8, 1975 describes an information system for detecting ground faults in a field of a rotor. A fault energizes LEDs to a level which is detectable by the detectors to trip an alarm. This system is not intended to transmit data or variables, but only to indicate a single condition. Thus, it is not necessary to transmit information over a complete shaft rotation and the system is not intended to do this.

SUMMARY OF THE INVENTION

The present invention provides for a telemetry system using infra-red radiation to transmit information in either or both directions between a rotor of a dynamoelectric machine and a location, externally of the machine. It may be used when the terminating end of the rotor shaft is not accessible or not available. The information may be transferred continuously in one direction at a time and because of the wider bandwidth (compared to that of an FM radio link) considerable information may be transferred in a given time.

The present invention uses a bounce system of infra-red coupling, that is, for example, a modulated infra-red source is mounted to the shaft of a dynamoelectric machine where it can direct infra-red radiation onto a surface or surfaces exposed to a stationary infra-red detector. By using two or more infra-red sources spaced equi-distant from one another around the shaft, it is possible to provide continuous transfer of data or information throughout a shaft revoluton. The infra-red source or transmitter may be either mounted on the rotation shaft or at the fixed location. It is convenient to have an infra-red transmitter and receiver as a single unit at both locations for transfer in both directions, however, because the path between the two locations involves a bounce with considerable inherent loss, the transmitter must have a fairly high output and the receiver a large amplification. Consequently it is convenient to inhibit or disable the receiver of a unit when the transmitter of that unit is operating. It is convenient to obtain a high level of radiation by providing the radiation in pulses of short duration with an off time duration several times the on time duration. This keeps the average power low while permitting a high radiated power.

Because the transmission path involves a bounce, it is not necessary to align a transmitter and cooperating receiver in a direct optical line and installation may be done by persons unskilled with optical or telemetry equipment.

In accordance with the present invention there is provided an infra-red telemetry system for transmitting information between a rotating member having a fixed axis of rotation and a stationary member, comprising a plurality of infra-red sources and at least one infra-red detector, the infra-red sources being spaced equidistant from one another around the axis of the rotating member and mounted to one of the rotating member and stationary member, and at least one infra-red detector being mounted to the other of the rotating member and stationary member, circuit means responsive to an input information signal to code the information into a pulse train and to energize the infra-red sources simultaneously in accordance with pulses in the pulse train, and a surface exposed to at least one of the infra-red sources and at least one of the infra-red detectors during each revolution of the rotating member for bouncing infra-red radiation from one of the infra-red sources to one of the infra-red detectors.

It is therefore an object of the invention to provide an improved infra-red telemetry system having a unit for mounting on an axially extending portion of the shaft of the rotor of a dynamoelectric machine for transmitting information by bouncing of infra-red radiation between the unit and a stationary external location.

It is another object of the invention to provide an improved infra-red telemetry system for transmitting information in either direction between the rotor of a dynamoelectric machine and an external location on machines where the terminating end of the shaft is not accessible.

DESCRIPTION OF THE PREFERRED EMBODIMENTS

Figure 1:
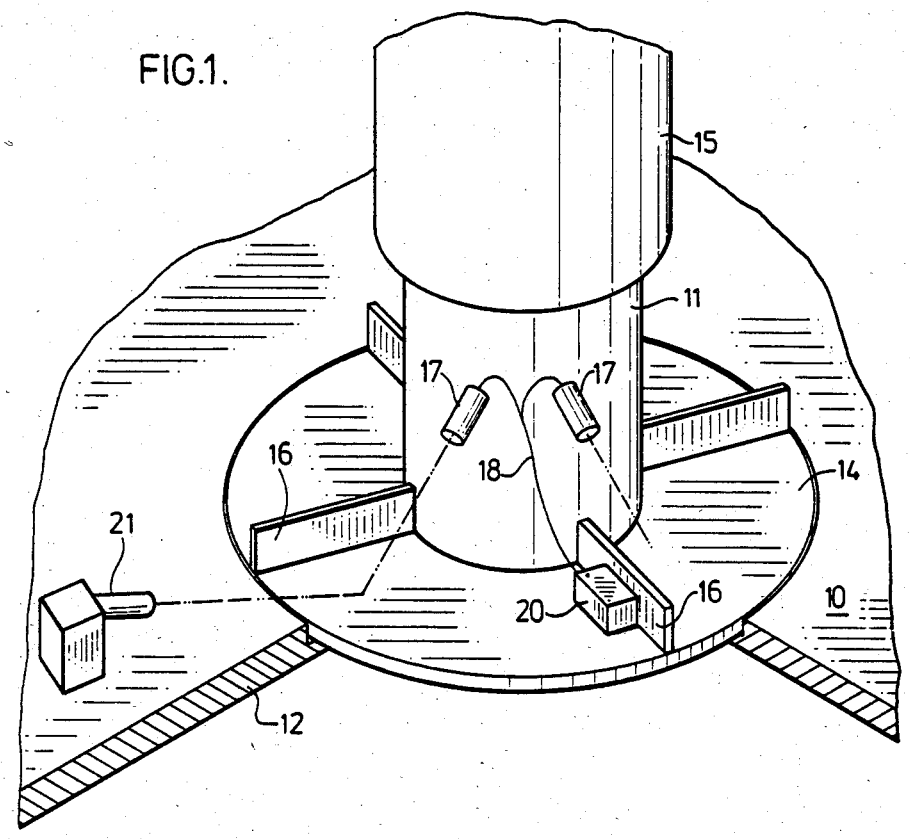
FIG. 1 is a partial perspective view of the top portion of a vertically mounted dynamoelectric machine showing the mounting of the telemetry system of the invention.

Referring to FIG. 1, the upper portion of a vertically mounted dynamoelectric machine 10, such as a water driven generator, is shown. The machine 10 has a shaft 11 and the spider 12 (only part of which is indicated) extends out from shaft 11. A cover plate 14 is normally mounted on the spider for rotation with the shaft 11. The shaft 11 terminates at the upper end in an assembly 15 which may contain a bearing and a brush and ring structure to conduct field current onto the rotor. In some instances the cover plate is mounted higher on the shaft adjacent assembly 15. Support arms 16 extend at least part way from the shaft over cover plate 14. The structure so far described is typical of the upper portion on a large water wheel generator, and further detail appears to be unnecessary.

The cover plate 14 should have a surface exposed to both the transmitter and receiver and should be able to dispose any infra-red radiation which strikes it over a relatively large angle. It should therefore not be a good reflecting surface such as a mirror-like surface. The surface of cover plate 14 is not critical. Any non-polished light coloured surface is suitable. A non-polished surface of a sheet metal painted a light colour is suitable. To distinguish it from a polished surface it can be referred to as a diffuse reflecting surface.

Mounted to shaft 11 are infra-red transmitter/-receiver units 17. These units preferably combine a source of infra-red radiation, i.e. a transmitter, and an infra-red detector as will subsequently be described in more detail. There are at least two and preferably more of these units 17 mounted at equally spaced distances around shaft 11 and directed at an angle towards cover plate 14. In other words, the receiver portion of unit 17 is angled to receive radiation bounced off the cover plate and concentrate the radiation on an infra-red detector, whereas the transmitter portion of unit 17 conveniently comprises a plurality of LEDs which direct infra-red radiation towards cover plate 14. If a single LED has the required power, it is of course necessary only to use one LED. The transmitter/receiver units 17 are each connected by a wire cable 18 to the operating circuitry contained in container 20 on one of the support arms 16.

A stationary transmitter/receiver unit 21 is mounted to the supporting structure around dynamoelectric machine 10 and is directed at an angle towards cover plate 14. The stationary unit 21 conveniently combines in one package the operating circuitry, the transmitter portion and the receiver portion.

The cover plate 14 is a rotating member. It has been found that the infra-red radiation can be bounced off stationary surfaces, although the surfaces would then have to extend substantially all around the machine in view of the transmitters and receivers.

It has been found that the telemetry system of the invention operates satisfactorily with two units on the shaft, spaced 180° apart, and one stationary unit. This is in a site where the dispersion of the infra-red on the bounce site is adequate and the radiated infra-red power is sufficient. It is, however, preferred to have two transmitter/receiver units 17 mounted on the shaft and three or four stationary transmitter/receiver units 21 spaced at equal intervals around the shaft and suitably directed at cover plate 14.

Figure 2:
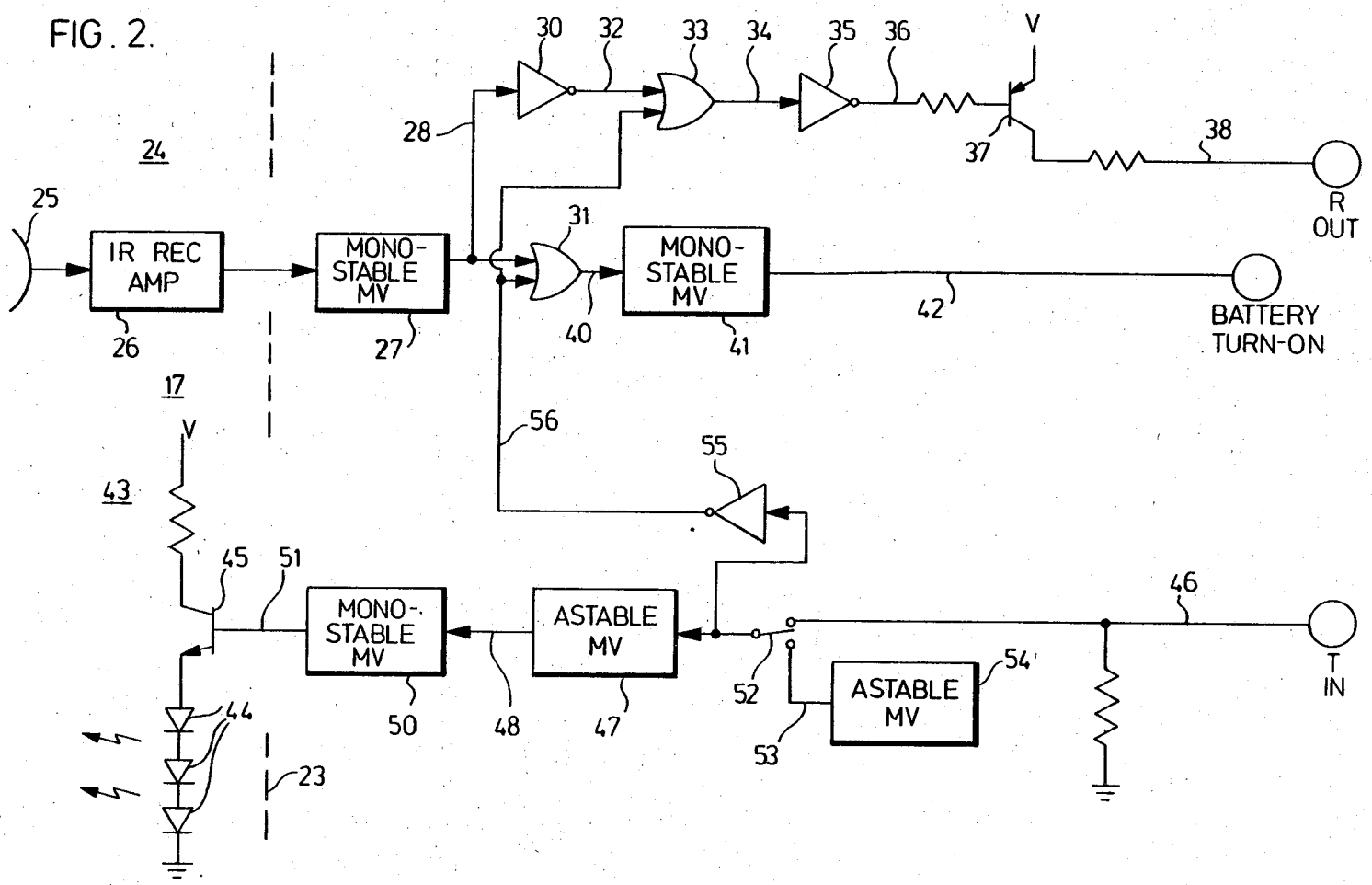
FIG. 2 is a simplified block schematic diagram of one form of apparatus according to the invention.

Referring now to FIG. 2, a transmitter/receiver unit 17 is shown with its operating circuitry in a simplified block form. The transmitter/receiver unit 17 is to the left of broken line 23 and the circuitry referred to as the operating circuitry is to the right. Considering first the receiver portion 24, a radiation collector 25 is indicated schematically for directing radiation onto an infra-red radiation detector represented by block 26. Block 26 comprises a radiation detector and which provides as an output a signal and an amplifier which may amplify the signal representing the detected infra-red radiation by a factor of the order of 4000.

The amplified signal is applied to a monostable multivibrator circuit 27. The incoming or received signal may be in the form of a pulse train, for example with a 2 microsecond pulse recurring at about 20 microsecond intervals. The multivibrator circuit 27 would, in this instance, have a frequency of perhaps 25 microseconds. Thus, as long as there is a signal present the multivibrator 27 remains triggered ON and provides a signal on conductor 28 to be applied to inverter amplifier 30 and to OR gate 31.

Let us assume for convenience that the output of multivibrator 27 is either 0 or 1, and that incoming pulses cause a 1 on conductor 28. This is applied to inverter 30 which, in turn provides a 0 output on conductor 32 which is one input to OR gate 33. Thus, OR gate 33 will provide a 0 output (neglecting for the moment the other input to OR gate 33) on conductor 34 which is applied to inverter amplifier 35 causing a 1 output on conductor 36. This is applied to the base of conductor 37 altering its conductive state and causing a 0 signal on conductor 38 and to $R_{out}$. It should be noted that at $R_{out}$ terminal, a 0 represents pulses being received and a 1 represents no signal and OFF.

Conductor 28 is connected as one input to OR gate 31 and when pulses are being received a 1 is applied to OR gate 31 resulting in a 1 on conductor 40 which triggers multivibrator 41. The monstable multivibrator 41 has a long period, for example, of the order of 10 seconds. When it is triggered ON it provides a signal on conductor 42 which turns on the battery supply for the associated data acquisition or data handling equipment (not shown). The battery will therefore remain turned on for 10 seconds after the pulses stop. The transmitter/-receiver unit 17 requires relatively little power and it remains on at all times.

Transmitter portion 43 includes a series of LED's 44 which are turned on when transistor 45 conducts. The LED's 44 provide infra-red radiation from the transmitter portion 43. The LED's 44 are turned on by a signal at terminal $T_{in}$.

Terminal $T_{in}$ has a level 1 for no signal and a level 0 for a signal. Assuming the input at terminal $T_{in}$ has just changed from a 1 to a 0, the change to 0 will appear on conductor 46 and trigger astable multivibrator 47 into operation. The multivibrator 47 may have a period of, for example, 20 microseconds. Every 20 microseconds it provides a signal on conductor 48 which triggers monostable multivibrator 50. The multivibrator 50 provides a 2 microsecond pulse, for example, each time it is triggered. The output from multivibrator 50 is connected by conductor 51 to the base of transistor 45 and the transistor is switched on for 2 microseconds at intervals of 20 microseconds to energize the LED's 44.

It will be apparent that informaation could be transferred by having the LED's 44 switch on to a steady state condition for a data signal and to off for no signal. It is, however, possible to obtain a much greater power output when they are energized for short periods such as 2 microseconds. High power is desirable when a bounce type of transmission path, which changes from instant to instant, is used.

Returning to FIG. 2, a switch 52 is provided having a normal position where it connects the input of multivibrator 47 to conductor 46, and a test position where it connects the input of multivibrator 47 to a conductor 53 and astable multivibrator 54. The astable multivibrator 54 can thus be switched into the circuit to trigger multivibrator 47 which controls multivibrator 50 to energize LED's 44 for test purposes.

When there is a data signal at $T_{in}$ there is a 0 on conductor 46 as was previously explained. This is applied to inverter amplifier 55 which provides a 1 on conductor 56. Conductor 56 is connected as an input to OR gate 31, and a 1 signal at OR gate 31 will provide a battery turn on signal on conductor 42. It will be seen that either the transmitting of a signal or the receiving of a signal will provide for a battery turn on. The battery turn on signal is for turning on a battery supply for associated equipment to which the unit 17 of the invention is connected, nevertheless it is referred to herein to provide a better understanding of the invention.

Still referring to FIG. 2, when a signal is applied at terminal $T_{in}$ there is a 0 on conductor 46 and a 1 on conductor 56. Conductor 56 is connected as one input to OR gate 33 and the 1 will thus be on conductor 34 and be applied to inverter amplifier 35 to provide a 0 on conductor 36. This will turn transistor 37 OFF and cause a 1 to appear on conductor 38. It will be seen that when there is a data signal or transmit signal at terminal $T_{in}$ tje receiver portion 24 is inhibited. This prevents the transmitted infra-red pulses from causing a signal at the receiver portion of the unit.

The operation of the apparatus of the invention will be clear from the preceding description and only a short explanation will be given. Assume the dynamoelectric machine 10 (FIG. 1) is operating and certain information is desired about a characteristic of the operation. A coded pulse train is used to control the transmission of infra-red pulses from stationary unit 21. The pulse length of pulses in the coded pulse train is several times greater than the length of the pulse which energizes the LED's to transmit infra-red radiation. For example, the LED's may be energized for 2 microseconds at 20 microsecond intervals. The pulse length of a pulse in the coded pulse train may be, for example, 200 or 300 microseconds or more. Thus, for each pulse in the coded pulse train there will be several of the 2 microsecond pulses of infra-red radiation. The infra-red pulses will be received by the moving transmitter/receiver unit 17 (FIGS. 1 and 2). The monostable multivibrator 27 (FIG. 2) will be triggered ON and remain on until the last infra-red pulse in a pulse of the coded pulse train is received. In this manner the coded pulse train will be reproduced at terminal $R_{out}$ (FIG. 2). The coded pulse train is applied to the data acquisition circuitry (not shown) where it actuates the circuitry to provide another coded pulse train representing the desired information. This other coded pulse train is applied to terminal $T_{in}$ where each pule in the code pulse train (again each pulse has a length several times the period of multivibrator 47 of FIG. 2) energizes the LED's 44 several times for 2 microseconds at 20 microseconds intervals. This is radiated and bounced off a convenient surface back to stationary transmitter/receiver unit 21 (FIG. 1) where the received radiation is decoded to obtain the desired information.

Figure 3:
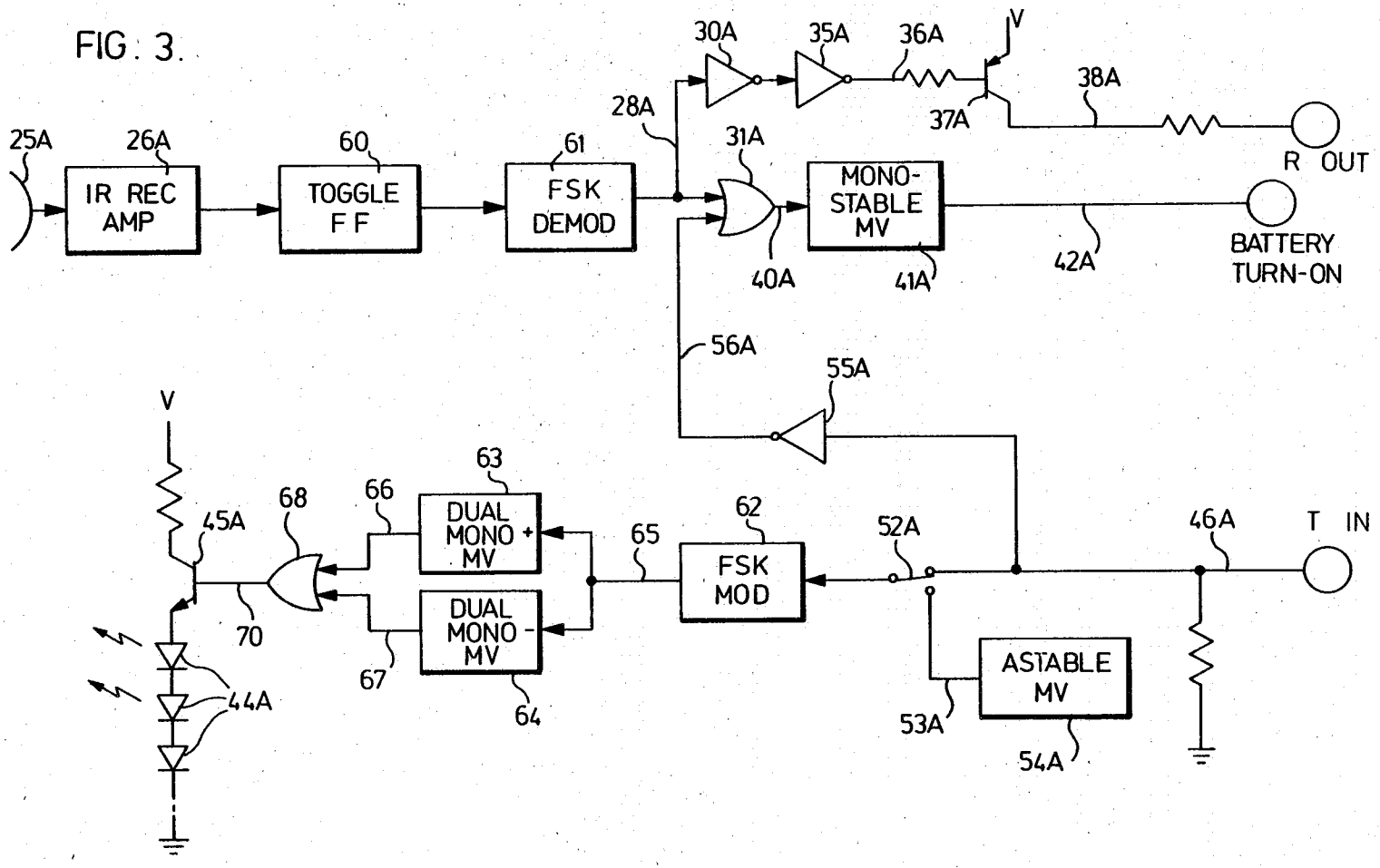
FIG. 3 is a simplified block schematic diagram of another form of the apparatus according to the invention using frequency shift keying, and FIGS. 4(*a*)–4(*h*) are a waveform diagrams useful in explaining the operation of the apparatus of FIG. 3.

Referring now to FIG. 3, there is shown a block schematic diagram of the invention in another form which uses frequency shift keying. As in FIG. 2 a radiation collector 25A receives the pulsed infra-red radiation and directs it onto an infra-red radiation detector represented by block 26A. A signal is provided which represents the pulsed radiation, and the signal is amplified and applied to a toggle flip-flop 60. The output of toggle flilp-flop 60 is applied to frequency shift keyer (FSK) demodulator 61 which demodulates the signal and provides an output on conductor 28A representing the signal. The operation of toggle flip-flop 60 and of FSK demodulator 61 will be described subsequently with reference to FIG. 4. The remaining circuitry of the receiver portion is quite similar to the corresponding circuitry of the FIG. 2 apparatus. The signal on conductor 28A amplified by amplifier inverters 30A and 35A. The amplified signal is on conductor 36A and is applied to the base of transistor 37A to control it. The output from transistor 37A is on conductor 38A and available at terminal $R_{out}$.

The circuitry of FIG. 3 does not include an inhibiting circuit as does the circuitry of FIG. 2 for inhibiting the receiver portion when the transmitter portion is transmitting. It will be apparent that it could be included if desired.

As in FIG. 2, the signal on conductor 28A of FIG. 3 is applied to OR gate 31A and the signal on conductor 40A triggers monostable multivibrator 41A to provide a battery turn-on signal on conductor 42A for turning on a battery which supplies other circuitry (not shown).

In the transmitter portion of FIG. 3 there is an information signal input at terminal $T_{in}$ and this signal is on conductor 46A. With switch 52A in its normal position as shown the signal is applied to frequency shift keyer modulator 62 which provides a frequency shift keyed output on conductor 65 which is applied to both of the dual monostable multivbrators 63 and 64. The output from each multivibrator 63 and 64 on conductors 66 and 67 respectively is applied to OR gate 68 which drives transistor 45A via conductor 70. Transistor 45A controls the power to LED's 44A.

As before the signal from conductor 46A is inverted by inverter 55A and applied via conductor 56A as an input to OR gate 31A. This ensures that a signal to cause a transmission will provide a battery turn-on signal on conductor 42A, as well as a received signal.

Figure 4:
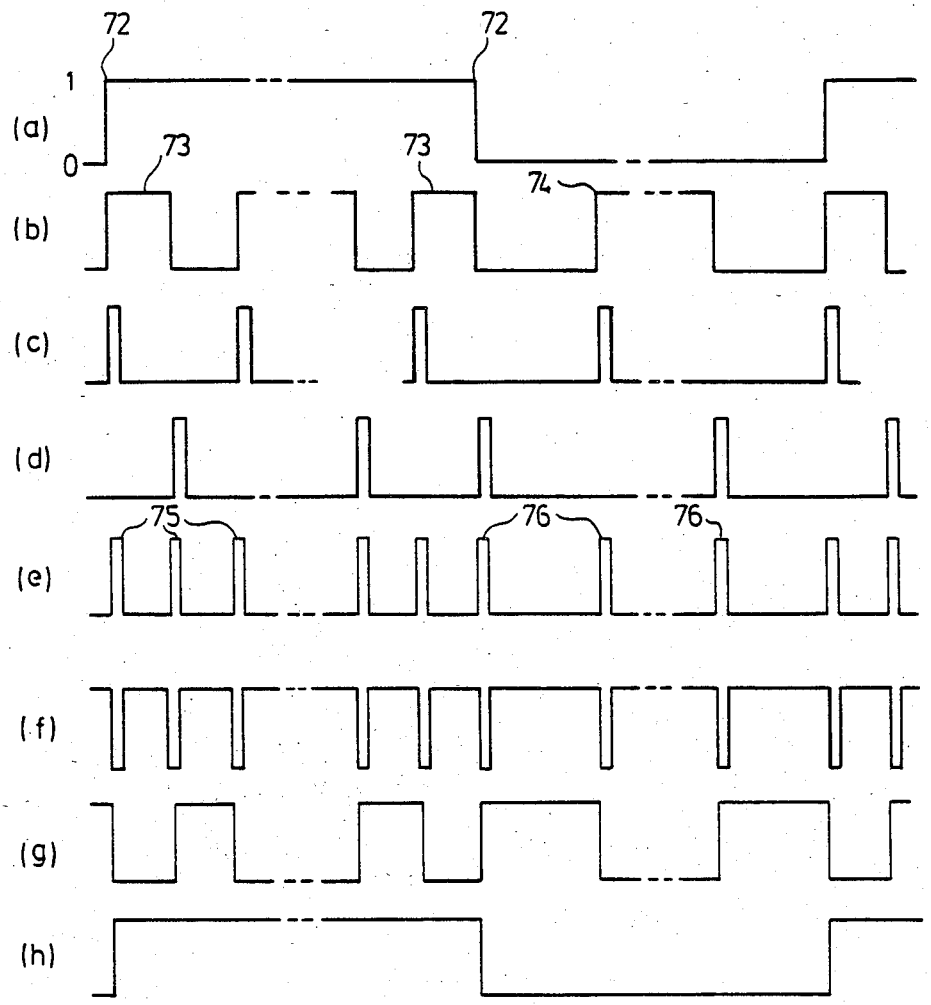

Referring now to the waveform diagram of FIG. 4 and to the circuitry of FIG. 3, the operation of the circuitry will be described. FIG. 4 shows typical waveforms in an idealized form. For convenience the transmitter portion will be describd first.

The waveform in FIG. 4(*a*) represents the signal typical of an input signal at $T_{in}$ and on conductor 46A.

The level 1 represents no signal and the level 0 in the waveform represents a signal. That is, the normal or at rest condition is a 1 level. The waveform shown in FIG. 4(*a*) might be a pulse signal representing, for one example, as ASC11 code. The waveform has been shown with a broken or interrupted portion to indicate a longer relative length to the pulses. For example, the time represented between points 71 and 72 might be of the order of 200 microseconds.

The signal represented by the waveform of FIG. 4(*a*) is applied to frequency shift keyer modulator 62 which provides an output represented by the waveform of FIG. 4(*b*). A 1 level applied to modulator 62 provides relatively shorter pulses 73 and a level 0 provides relatively longer pulses 74. The output represented by waveform of FIG. 4(*b*) is on conductor 65 and is applied to both dual monostable multivibrators 63 and 64 which are triggered respectively by positive going and negative going pulses. The waveforms of FIGS. 4(*e*) and 4(*d*) respectively represent the outputs of multivibrators 63 and 64 on conductors 66 and 67. These two signals are combined by OR gate 68 and the resulting signal is on conductor 70 and is represented by the waveform of FIG. 4(*e*). This waveform consequently also represents generally the energization of LED's 44A.

In the idealized waveform of FIG. 4(*e*) the pulses which are closer together, that is pulses 75, represent one frequency in the frequency shifted output signal, and the pulses which are farther apart, that is pulses 76, represent the other frequency. These frequencies, by way of example only, might be of the order of 25 kHz and 21 kHz.

The waveform of FIG. 4(*f*) represents the signal output of receiver-amplifier 26A, that is it represents the signal applied to toggle flip-flop 60. The toggle flip-flop 60 is triggered to one state by a given pulse and to opposite state by the succeeding pulse, and consequently it gives an output represented by the waveform of FIG. 4(*g*). The frequency shift keyer demodulator 61 receives this signal and provides on conductor 28A a signal represented by the waveform of FIG. 4(*h*). This signal controls the operation of transistor 37A. As before the signal at terminal $R_{out}$ has a 1 level representing an OFF or no signal and a 0 level representing data.

It is believed the operation of the invention will be clear.

It will be understood by those skilled in the art that signals representing data or information in the form of a pulse train can readily be changed or inverted as becomes convenient.

The embodiments of the invention in which an exclusive property or privilege is claimed are defined as follows:

1. An infra-red telemetry system for transmitting information between a rotating member having a fixed axis of rotation and a stationary member, comprising a plurality of infra-red sources and at least one infra-red detector, said infra-red sources being spaced equidistant from one another around the axis of said rotating member and mounted to one of said rotating member and said stationary member, and said at least one infra-red detector being mounted to the other of said rotating member and stationary member, circuit means responsive to an input information signal to code said information into a pulse train and to energize said infra-red sources simultaneously in accordance with pulses in said pulse train, and a surface exposed to at least one of said infra-red sources and at least one of said infra-red detectors during each revolution of said rotating member for bouncing infra-red radiation from one of said infra-red sources to one of said infra-red detectors.

2. An infra-red telemetry system for transmitting information between a rotating member having a fixed axis of rotation and a stationary location, comprising at least two infra-red sources fixed to said rotating member at positions equidistant around said rotating member, at least one infra-red detector mounted at said stationary location, circuit means responsive to information to code said information into a pulse train and to energize said infra-red sources simultaneously in accordance with pulses in said pulse train, and a surface exposed to at least one of said infra-red sources and at least one of said infra-red detectors during each revolution for bouncing radiation received from said source onto said detector.

3. An infra-red telemetry system according to claim 1 or 2 in which said at least two infra-red sources are four infra-red sources.

4. An infra-red telemetry system according to claim 1 or 2 in which said at least one infra-red detector is two infra-red detectors.

5. An infra-red telemetry system according to claim 1 or 2 in which said pulse train comprises pulses of the order of 2 microseconds duration.

6. An infra-red telemetry system according to claim 1 or 2 in which said surface is a diffuse reflecting surface.

7. An infra-red telemetry system according to claims 1 or 2 in which each infra-red source comprises at least one light-emitting diode.

8. An infra-red telemetry system for transmitting information between a rotating rotor shaft of a dynamoelectric machine and an adjacent stationary location, the terminating ends of said shaft being unavailable for telemetry apparatus, said dynamoelectric machine having a rotor supported by said rotor shaft and a cover plate having an exposed surface extending around said shaft for covering at least a portion of said rotor, comprising a plurality of infra-red transmitter/receiver units having a transmitter portion and a receiver portion, at least two of said units being spaced equidistant from one another around the axis of said shaft and mounted to one of said rotating shaft and said stationary location, and at least one of said units being mounted to the other of said rotating shaft and said stationary location, said transmitter portion including infra-red sources and circuit means for receiving an information signal and responsive thereto for providing a coded series of short duration pulses to energize said infra-red sources, said short duration pulses representing said information signal, said receiver portion including an infra-red detector and circuit means connected thereto for receiving pulse signals detected by said detector and representing coded information and responsive to said pulse signals for providing a signal representing said information, said units being directed towards said cover plate whereby infra-red radiation pulses are bounced off said cover plate between a unit mounted on said rotating shaft and said stationary location.

9. An infra-red telemetry system according to claim 8 in which there are at least two of said transmitter/-receiver units mounted to said shaft and there are at least two of said transmitter/receiver units mounted at a stationary location.

10. An infra-red telemetry system according to claim 8 in which there are four of said transmitter/receiver units mounted to said shaft and two of said transmitter/-receiver units mounted at stationary locations.

11. An infra-red telemetry system according to claim 8, 9 or 10 in which said short duration pulses are of the order of 2 microseconds duration.

12. An infra-red telemetry system according to claim 8 in which said circuit means of said transmitter portion includes a frequency shift keying modulator for providing said coded series of short duration pulses, and said circuit means of said receiver portion includes a frequency shift keyer demodulator means for demodulating frequency shift keyed pulses to provide said signal representing said information.

13. An infra-red telemetry system for transmitting information between a rotating rotor shaft of a dynamoelectric machine and an adjacent stationary location, the terminating ends of said shaft being unavailable for telemetry apparatus, said dynamoelectric machine having a rotor supported by said rotor shaft and a plate having an exposed diffuse reflecting surface extending around said shaft, comprising at least three infra-red transmitter/receiver units having a transmitter portion and a receiver portion, at least two of said units being spaced equidistant from one another around said shaft and mounted to said shaft, and at least one of said units being mounted at said stationary location, said transmitter position having circuit means including an input for receiving an information signal in the form of pulses having a first duration, means responsive to each said pulse having a first duration to provide a predetermined number of pulses having a second duration much shorter than said first duration, and a plurality of infra-red sources responsive to said pulses having a second duration to provide infra-red radiation directed towards said surface for bouncing radiation off said surface between said shaft and said stationary location, said receiver portion having circuit means including an infra-red detector responsive to said pulses of infra-red radiation having a second duration bounced from said surface to provide a signal corresponding to said infra-red pulses of said second duration, means to detect groups of said pulses of said second duration and to provide therefrom an output signal comprising pulses having said first duration representing said information signal, and an output for said output signal.

14. An infra-red telemetry system according to claim 13 and further including in each said unit means to inhibit said circuit means of said receiver portion when said transmitter portion is providing pulses of infra-red radiation.

* * * * *